US005540336A

United States Patent [19]

Schreck et al.

[11] Patent Number: 5,540,336

[45] Date of Patent: Jul. 30, 1996

[54] METHOD OF PRODUCING IRON ORE CONCENTRATES BY FROTH FLOTATION

[75] Inventors: Berthold Schreck; Rita Koester, both of Duesseldorf, Germany

[73] Assignee: Henkel Kommanditgesellschaft auf Aktien, Duesseldorf, Germany

[21] Appl. No.: 211,522

[22] PCT Filed: Sep. 25, 1992

[86] PCT No.: PCT/EP92/02224

§ 371 Date: Apr. 4, 1994

§ 102(e) Date: Apr. 4, 1994

[87] PCT Pub. No.: WO83/06935

PCT Pub. Date: Apr. 15, 1993

[30] Foreign Application Priority Data

Oct. 4, 1991 [DE] Germany ..... 41 33 063.3

[51] Int. Cl.[6] ..... B03D 1/02; B03D 1/01

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 3,363,758 | 1/1968 | Cronberg . | |
| 4,139,481 | 2/1979 | Wang et al. | 252/61 |
| 4,168,227 | 9/1979 | Polgaire et al. | 209/166 |
| 4,206,045 | 6/1980 | Wang et al. | 209/166 |
| 4,309,282 | 2/1982 | Smith et al. | 209/166 |
| 4,319,987 | 3/1982 | Shaw et al. | 209/166 |
| 4,457,850 | 7/1984 | Tesmann et al. | 252/61 |
| 4,472,270 | 9/1984 | Agrawal et al. | 209/166 |
| 4,650,865 | 3/1987 | Lange et al. | 544/174 |
| 4,732,667 | 3/1988 | Hellsten et al. | 209/166 |
| 4,790,932 | 12/1988 | Kottwitz | 209/166 |

FOREIGN PATENT DOCUMENTS

| | | |
|---|---|---|
| 8653766 | 8/1986 | Australia . |
| 1100239 | 4/1981 | Canada . |
| 0108914 | 5/1984 | European Pat. Off. . |
| 0219057 | 4/1987 | European Pat. Off. . |
| 0270018 | 6/1988 | European Pat. Off. . |
| 2367820 | 5/1978 | France . |
| 2237359 | 2/1973 | Germany . |
| 3238060 | 4/1984 | Germany . |
| 3504242 | 8/1986 | Germany . |
| 3723323 | 1/1989 | Germany . |
| 3723826 | 1/1989 | Germany . |

OTHER PUBLICATIONS

Erzmetall; vol. 30, No. 11, Nov. 1977, Stuttgart DE pp. 505–510.

J. Falbe, U. Hasserodt (ed.), "Katalysatoren, Tenside und Mineralöladditive", Thieme Verlag, Stuttgart, 1978 (Document Unavailable).

J. Falbe (ed.), "Surfactants in Consumer Products", Springer Verlag, Berlin, 1986 (Document Unavailable).

H. Schubert, "Aufbereitung fester mineralischer Stoffe", Leipzig, 1967.

D. B. Puchas (Ed.), "Solid/Liquid Separation Equipment Scale–Up", Croydon, 1977.

E. S. Perry, C. J. VanOss, E. Grushka (Ed.), "Separation and Purification Methods", New York, 1973–1978.

*Primary Examiner*—Thomas M. Lithgow

*Attorney, Agent, or Firm*—Ernest G. Szoke; Norvell E. Wisdom, Jr.; Patrick J. Span

[57] ABSTRACT

Iron ore concentrates can be obtained by the flotation of iron ores providing mixtures containing at least one ether canine of formula (I):

$$R^1O—(C_nH_{2n})_y—NH—(C_mH_{2m}—NH)_xH,$$

in which $R^1$ is a linear or branched chain aliphatic hydrocarbon moiety having 6 to 22 carbon atoms and 0, 1, 2 or 3 double bonds; n and m independently of one another represent the number 1, 2 or 3; x=0 or the number 1, 2 or 3; and y=2 or 3, and at least one other anionic and/or nonionic collector.

7 Claims, No Drawings

METHOD OF PRODUCING IRON ORE CONCENTRATES BY FROTH FLOTATION

FIELD OF THE INVENTION

This invention relates to a process for the production of iron ore concentrates by flotation of iron ores, in which mixtures of special ether amines with anionic and/or nonionic collectors are used as collectors.

PRIOR ART

Iron ores occur in nature mostly in the form of oxides, among which magnetite, hematite, martite, limonite and goethite are the most well known. These oxides mainly contain silicates, more particularly quartz, and also phosphorus and sulfur compounds as impurities. For the production of high-quality steel, the impurities mentioned have to be removed from the iron ores; this is generally done by flotation.

To this end, the iron ore is normally first size-reduced and dry-ground but preferably wet-ground and suspended in water. A collector is then added, often in conjunction with other reagents, including frothers, regulators, deactivators and/or activators, to support removal of the valuable minerals from the gangue minerals of the ore in the subsequent flotation stage. Before air is injected into the suspension to produce foam at its surface and to initiate the flotation process, these reagents are normally left to act on the finely ground ore for a certain time (conditioning). The collector hydrophobicizes the surface of the impurities present in the iron ore, so that the minerals adhere to the gas bubbles formed during aeration. The mineral components are selectively hydrophobicized so that the gangue is floated out and the concentrate remains behind as the residue (indirect flotation).

In the flotation of iron ores, aminic compounds are preferably used as collectors. Their function is to be selectively adsorbed onto the surface of the impurities to ensure high depletion of these unwanted constituents in the flotation concentrate. In addition, the collectors are intended to form a stable, but not overly stable, flotation foam.

U.S. Pat. No. 4,168,227 describes a process for the removal of silicate impurities from iron ores in which alkylamines, alkylenediamines and ether amines are used as collectors.

According to Australian patent AU 86/53 766, the removal of silicates and phosphates from iron ores by flotation is carried out with collector mixtures containing ether amines and ether carboxylic acid amides.

The use of anionic surfactants as collectors or co-collectors in the flotation of nonsulfide ores is known from a number of publications. Corresponding examples are alkyl phosphates and alkylether phosphates [*Erzmetall* {Title in English: Heavy Metal} 30, 505 (1977)], ether carboxylic acids [DE 22 37 359 A1], sulfosuccinamides and succinamates [U.S. Pat. Nos. 4,206,045; 4,309,282 and 4,139,481] and alkyl aspartic acids [EP 0 270 018 A1].

However, the purification of iron ores by flotation to form concentrates which satisfy the increasing quality requirements of industry is still problematical. In particular, there are no collector systems with which iron ore concentrates containing less than 0.015% by weight of phosphorus can be produced.

OBJECT OF THE INVENTION

Accordingly, the problem addressed by the present invention was to provide an improved flotation process for the production of iron ore concentrates which would not be attended by any of the disadvantages mentioned above.

DESCRIPTION OF THE INVENTION

The present invention relates to a process for the production of iron ore concentrates by flotation, in which crushed iron ore is mixed with water to form a suspension, air is introduced into the suspension in the presence of a reagent system, and the froth formed is removed together with the solids floated therein, characterized in that mixtures containing a) at least one ether amine corresponding to formula (I):

$$R^1O—(C_nH_{2n})_y—NH—(C_mH_{2m}—NH)_xH \quad (I),$$

in which $R^1$ is a linear or branched aliphatic hydrocarbon moiety having 6 to 22 carbon atoms and 0, 1, 2 or 3 double bonds; n and m independently of one another represent the number 1, 2 or 3; x=0 or the number 1, 2 or 3; and y=2 or 3, and b) at least one other anionic and/or nonionic collector are used as collectors.

It has surprisingly been found that the collector mixtures to be used in accordance with the invention are capable of selectively removing phosphorus impurities from iron ores without any adverse effect on the cationic flotation of the silicates. The invention includes the observation that phosphorus flotation and silicate flotation can be carried out both separately and also in a single step. In particular, it has been found that the concentrates obtainable by the process according to the invention have phosphorus contents of less than 0.015% by weight, based on the concentrate.

Ether amines corresponding to formula (I) are known compounds which may be obtained by the relevant methods of preparative organic chemistry. They are normally produced from fatty alcohol sulfates which are reacted with alkanolamines or aminoalkyl alkanolamines at temperatures of around 180° C. in the presence of alkali metal hydroxides, alkali metal sulfate being formed as a secondary product [DE 35 04 242 A1].

Starting materials for the ether amines to be used in accordance with the invention are fatty alcohol sulfates based on saturated or unsaturated fatty alcohols and also primary amines and diamines. Typical examples are reaction products of octyl sulfate, decyl sulfate, lauryl sulfate, myristyl sulfate, cetyl sulfate, stearyl sulfate, oleyl sulfate, elaidyl sulfate, petroselinyl sulfate, linolyl sulfate, linolenyl sulfate, arachyl sulfate, gadoleyl sulfate, behenyl sulfate and erucyl sulfate with methanolamine, ethanolamine, n-propanolamine, i-propanolamine, aminoethyl ethanolamine, aminoethyl propanolamine, aminopropyl ethanolamine and aminopropyl propanolamine. As usual in oleochemistry, sulfates based on technical fatty alcohol cuts may also be reacted with the amines mentioned. Ether amines of formula (I), in which $R^1$ is an alkyl moiety having 6 to 18 and, more particularly, 8 to 12 carbon atoms, are preferred.

Anionic collectors in the context of the invention are anionic surfactants of the fatty acid, alkyl sulfate, alkyl ether sulfate, alkyl sulfosuccinate, alkyl sulfosuccinamate, alkyl benzenesulfonate, alkane sulfonate, petroleum sulfonate, acryl lactylate, sarcoside, alkyl phosphate, alkylether phosphate, alkyl aspartic acid and ether carboxylic acid types. All these anionic surfactants are known compounds of which the production—unless other otherwise stated—is described, for example, in J. Falbe, U. Hasserodt (ed.), *Katalysatoren, Tenside und Mineralöladditive* [Title in English: Catalysts, Surfactants, and Mineral Oil Additives] (Thieme Verlag, Stuttgart, 1978) and in J. Falbe (ed.), *Surfactants in Consumer Products* (Springer Verlag, Berlin, 1986).

The fatty acids used are, above all, the linear fatty acids obtained from vegetable or animal fats and oils, for example by hydrolysis and optionally fractionation and/or separation by the rolling-up process; these fatty acids correspond to formula (II):

$$R^2COOY \quad \text{(II)},$$

in which $R^2$ is an aliphatic hydrocarbon moiety having 12 to 18 carbon atoms and 0, 1, 2 or 3 double bonds and Y is an alkali metal, alkaline earth metal or ammonium ion. Particular significance is attributed to the sodium and potassium salts of oleic acid and tall oil fatty acid.

Suitable alkyl sulfates are the water-soluble salts of sulfuric acid semiesters of fatty alcohols corresponding to formula (III):

$$R^3—O—SO_3Z \quad \text{(III)},$$

in which $R^3$ is a linear or branched alkyl moiety having 8 to 22 and preferably 12 to 18 carbon atoms and Z is an alkali metal or an ammonium ion.

Suitable alkylether sulfates are the water-soluble salts of sulfuric acid semiesters of fatty alcohol polyglycol ethers corresponding to formula (IV):

$$R^4—(OCH_2\underset{\underset{R^5}{|}}{CH})_nOSO_3Z, \quad \text{(IV)}$$

in which $R^4$ is a linear or branched alkyl moiety having 8 to 22 and preferably 12 to 18 carbon atoms, $R^5$ is hydrogen or a methyl group and n=1 to 30, preferably 2 to 15, and Z is as defined above.

Suitable alkyl sulfosuccinates are sulfosuccinic acid monoesters of fatty alcohols corresponding to formula (V):

$$R^6—OOC—CH_2—\underset{\underset{SO_3Z}{|}}{CH}—COOZ, \quad \text{(V)}$$

in which $R^6$ is a linear or branched alkyl moiety having 8 to 22 and preferably 12 to 18 carbon atoms and Z is as defined above.

Suitable alkyl sulfosuccinamates are sulfosuccinic acid monoamides of fatty amines corresponding to formula (VI):

$$R^7—NH—OC—CH_2—\underset{\underset{SO_3Z}{|}}{CH}—COOZ, \quad \text{(VI)}$$

in which $R^7$ is a linear or branched alkyl moiety having 8 to 22 and preferably 12 to 18 carbon atoms and Z is as defined above.

Suitable alkylbenzene sulfonates are substances corresponding to formula (VII):

$$R^8—C_6H_4—SO_3Z \quad \text{(VII)},$$

in which $R^8$ is a linear or branched alkyl moiety having 4 to 16 and preferably 8 to 12 carbon atoms and Z is as defined above.

Suitable, alkane sulfonates are substances corresponding to formula (VIII):

$$R^9—SO_3Z \quad \text{(VIII)},$$

in which $R^9$ is a linear or branched alkyl moiety having 12 to 18 carbon atoms and Z is as defined above.

Suitable petroleum sulfonates are substances obtained by reaction of lubricating oil fractions with sulfur trioxide or oleum and subsequent neutralization with sodium hydroxide. Products in which the hydrocarbon moieties mainly have chain lengths of 8 to 22 carbon atoms are particularly suitable.

Suitable acyl lactylates are substances corresponding to formula (IX):

$$R^{10}—CO—\underset{\underset{CH_3}{|}}{CH}—COOZ, \quad \text{(IX)}$$

in which $R^{10}$ is an aliphatic, cycloaliphatic or alicyclic, optionally hydroxyl-substituted hydrocarbon moiety having 7 to 23 carbon atoms and 0, 1, 2 or 3 double bonds and Z is as defined above. The production and use of acyl lactylates in flotation is described in German patent application DE 32 38 060 A1.

Suitable sarcosides are substances corresponding to formula (X):

$$R^{11}—CO—\overset{\overset{CH_3}{|}}{N}—CH_2COOH, \quad \text{(X)}$$

in which $R^{11}$ is an aliphatic hydrocarbon moiety having 12 to 22 carbon atoms and 0, 1, 2 or 3 double bonds.

Suitable alkyl phosphates and alkylether phosphates are substances corresponding to formulae (XI) and (XII):

$$R^{12}—(OCH_2CH_2)_pO—\overset{\overset{O}{||}}{\underset{\underset{OZ}{|}}{P}}—OZ, \quad \text{(XI)}$$

and $$R^{12}—(OCH_2CH_2)_pO—\overset{\overset{O}{||}}{\underset{\underset{OZ}{|}}{P}}—O(CH_2CH_2O)_q—R^{13}, \quad \text{(XII)}$$

in which $R^{12}$ and $R^{13}$ independently of one another represent an alkyl or alkenyl moiety having 8 to 22 carbon atoms and p and q have a value of 0 in the case of the alkyl phosphates and a value of 1 to 15 in the case of the alkylether phosphates and Z is as defined above.

If the ether amines are used in admixture with alkyl phosphates or alkylether phosphates in accordance with the invention, the phosphates may be present as monophosphates or diphosphates. In this case, mixtures of monophosphates and dialkyl phosphates such as are formed in the industrial production of such compounds are preferably used.

Alkyl aspartic acids are understood to be compounds corresponding to formula (XIII):

$$R^{14}—NH—\underset{\underset{COOZ}{|}}{CH}—CH_2—COOZ, \quad \text{(XIII)}$$

in which $R^{14}$ is an alkyl or alkenyl moiety having 8 to 22 carbon atoms and Z is as defined above.

Finally, ether carboxylic acids are compounds corresponding to formula (XIV):

$$R^{15}O—(CH_2CH_2O)_n—CH_2—COOZ \quad \text{(XIV)},$$

in which $R^{15}$ is an alkyl or alkenyl moiety having 8 to 22 carbon atoms and n is 0 or a number of 1 to 10 and Z is as defined above.

Nonionic collectors in the context of the invention are nonionic surfactants of the fatty alcohol polyglycol ether, alkylphenol polyglycol ether, fatty acid polyglycol ester, fatty acid amide polyglycol ether, fatty amine polyglycol ether, mixed ether, hydroxy mixed ether and alkyl glycoside types. All these nonionic surfactants are known compounds of which the production—unless otherwise stated—is described, for example, in J. Falbe, U. Hasserodt (ed.), *Katalysatoren, Tenside und Mineralöladditive* [Title in English: Catalysts, Surfactants, and Mineral Oil Additives] (Thieme Verlag, Stuttgart, 1978) and in J. Falbe (ed.), *Surfactants in Consumer Products* (Springer Verlag, Berlin, 1986).

Suitable fatty alcohol polyglycol ethers are adducts of on average n moles of ethylene and/or propylene oxide with fatty alcohols which correspond to formula (XV):

$$R^{16}(OCH_2\underset{\underset{R^5}{|}}{C}H)_nOH, \qquad (XV)$$

in which $R^{16}$ is a linear or branched alkyl moiety having 8 to 22 and preferably 12 to 18 carbon atoms, $R^5$ is hydrogen or a methyl group and n is a number of 1 to 30 and preferably 2 to 15.

Suitable alkylphenol polyglycol ethers are adducts of on average n moles of ethylene and/or propylene glycol with alkylphenols which correspond to formula (XVI):

$$R^{17}-C_6H_4-(OCH_2\underset{\underset{R^5}{|}}{C}H)_nOH, \qquad (XVI)$$

in which $R^{17}$ is an alkyl moiety having 4 to 15 and preferably 8 to 10 carbon atoms and $R^5$ and n are as defined above.

Suitable fatty acid polyglycol esters are adducts of on average n moles of ethylene oxide and/or propylene oxide with fatty acids which correspond to formula (XVII):

$$R^{18}-CO(OCH_2\underset{\underset{R^5}{|}}{C}H)_nOH, \qquad (XVII)$$

in which $R^{18}$ is an aliphatic hydrocarbon moiety having 5 to 21 carbon atoms and 0, 1, 2 or 3 double bonds and $R^5$ and n are as defined above.

Suitable fatty acid amidopolyglycol ethers are adducts of on average n moles of ethylene and/or propylene oxide with fatty acid amides which correspond to formula (XVIII):

$$R^{19}-CO-NH(OCH_2\underset{\underset{R^5}{|}}{C}H)_nOH, \qquad (XVIII)$$

in which $R^{19}$ is an aliphatic hydrocarbon moiety having 5 to 21 carbon atoms and 0, 1, 2 or 3 double bonds and $R^5$ and n are as defined above.

Suitable fatty amine polyglycol ethers are adducts of on average n moles of ethylene stud/or propylene oxide with fatty amines which correspond to formula (XIX):

$$R^{20}-NH(OCH_2\underset{\underset{R^5}{|}}{C}H)_nOH, \qquad (XIX)$$

in which $R^{20}$ is an alkyl moiety having 6 to 22 carbon atoms and $R^5$ and n are as defined above.

Suitable mixed ethers are reaction products of fatty alcohol polyglycol ethers with alkyl chlorides corresponding to formula (XX):

$$R^{21}-(OCH_2\underset{\underset{R^5}{|}}{C}H)_n-O-R^{22}, \qquad (XX)$$

in which $R^{21}$ is an aliphatic hydrocarbon moiety having 6 to 22 carbon atoms and 0, 1, 2 or 3 double bonds, $R^{22}$ is an alkyl moiety having 1 to 4 carbon atoms or a benzyl moiety and $R^5$ and n are as defined above.

Suitable hydroxy mixed ethers are substances corresponding to formula (XXI):

$$R^{23}-\underset{\underset{OH}{|}}{C}H-CH_2-(OCH_2\underset{\underset{R^5}{|}}{C}H)_n-O-R^{24}, \qquad (XXi)$$

in which $R^{23}$ is an alkyl moiety having 6 to 16 carbon atoms, $R^{24}$ is an alkyl moiety having 1 to 4 carbon atoms or a benzyl moiety and $R^5$ and n are as defined above. The production of the hydroxy mixed ethers is described in German patent application DE 37 23 323 A1.

Suitable alkyl glycosides are substances corresponding to formula (XXII):

$$R^{25}-O-(G)_x \qquad (XXII),$$

in which G stands for a glycose unit derived from a sugar having 5 or 6 carbon atoms, x is a number of 1 to 10 and $R^{25}$ is an aliphatic hydrocarbon moiety having 6 to 22 carbon atoms and 0, 1, 2 or 3 double bonds. G preferably stands for a glucose unit and x is preferably a number of 1.1 to 1.6. The production of the alkyl glycosides is described, for example, in German patent application DE 37 23 826 A1.

The mixtures of the ether amines with the anionic and/or nonionic collectors may have a content of 5 to 95% by weight and preferably 10 to 60% by weight of the ether amines. Particularly advantageous results are obtained with mixtures which, besides ether amines, contain fatty acids, alkyl aspartic acids and/or ether carboxylic acids or alkyl sulfosuccinamates, alkyl phosphates and/or alkylether phosphates.

To obtain economically useful results in the flotation of iron ore, the collector mixture has to be used in a certain minimum quantity. At the same time, however, there is a maximum quantity which must not be exceeded because otherwise foaming becomes excessive and selectivity towards the impurities to be floated out decreases. The quantities in which the collector mixtures to be used in accordance with the invention may be employed are normally from 20 to 2,000 g and preferably from 50 to 1,000 g per tonne of crude ore.

The process according to the invention includes the use of typical flotation reagents, such as for example frothers, regulators, activators, deactivators, etc. The flotation process is carried out under the same conditions as known processes. Information on the technological background of ore preparation can be found in the following literature references: H. Schubert, *Aufbereitung fester mineralischer Stoffe* [Title in English: Separation of Mineral Substances] (Leipzig, 1967); D. B. Puchas (Ed.), *Solid/Liquid Separation Equipment Scale-Up* (Croydon, 1977); E. S. Perry, C. J. VanOss, E. Grushka (Ed.), *Separation and Purification Methods* (New York, 1973–1978).

The following Examples are intended to illustrate the invention without limiting it in any way.

Examples

I. Collectors used and collectors

TABLE 1

| Collectors | |
|---|---|
| | Aminic collectors |
| A1) | Ether amine based on |

TABLE 1-continued

| Collectors | |
|---|---|
| | Aminic collectors |
| | n-propylamine and $C_{8-10}$ fatty alcohol sulfate $(C_{8-10}H_{17-21})$-O-$(CH_2)_3NH_2$ |
| A2) | Ether amine based on n-propylamine and $C_{8-12}$ fatty alcohol sulfate $(C_{8-12}H_{17-25})$-O-$(CH_2)_3$-$NH_2$ |
| A3) | Ether amine based on Aminopropyl propanolamine and decyl sulfate $C_{10}H_{21}$-O-$(CH_2)_3$-NH-$(CH_2)_3$-$NH_2$ |

TABLE 2

| Collectors | |
|---|---|
| | Anionic and nonionic collectors |
| B1) | Ether phosphate sodium salt based on $C_{12-14}$ coconut oil fatty alcohol; n = 1,2 $[(C_{12-14}H_{25-29})-(OCH_2CH_2)_{10}-O]_n-PO-(ONa)_{3-n}$ |
| B2) | Ether carboxylic acid sodium salt based on $C_{12-18}$ coconut oil fatty alcohol 7 EO adduct $(C_{12-18}H_{25-37})-O-(CH_2CH_2O)_7-CH_2-COONa$ |
| B3) | N-tallow alkyl sulfosuoccinamide disodium salt $(C_{16-18}H_{33-37})-NH-OC-CH_2CH(SO_3Na)-COONa$ |
| B4) | N-tallow alkyl aspartic acid disodium salt $(C_{16-18}H_{33-37})-NH-CH(CH_2COONa)-COONa$ |
| B5) | $C_{12-18}$ coconut oil fatty alcohol 2EO,4PO adduct $(C_{12-18}H_{33-37})-O-[(CH_2CH_2O)_2(CH_2CHO)_4]-H$ ($CH_3$) |
| B6) | Hydrolyzed rapeseed oil fatty acid Fatty acid mixture containing >80% by weight oleic acid |
| B7) | Tallow alkyl sulfosuccinate disodium salt $(C_{16-18}H_{33-37})-OOC-CHCOONa$ ($SO_3Na$) |

II. Ores used

Two North American hematite samples and a magnetite ore were used for the tests. In addition to iron oxide, the hematite ore contained approximately 44% by weight of silicates (mainly quartz) and 0.1 to 0.2% by weight of apatite. The exact chemical analysis of the ore samples used is shown in Table 3:

TABLE 3

Analysis of the ore samples (mean values)

| Ore type | Fe % by weight | P % by weight | $SiO_2$ % by weight |
|---|---|---|---|
| Hematite sample I | 35.9 | 0.038 | 43.9 |
| Hematite sample II | 38.4 | 0.025 | 44.8 |
| Magnetite | 65.0 | 0.015 | 7.0 |

III. Flotation examples for hematite ore

Preparation involved the following steps:

grinding, selective desludging and rougher flotation.

The aminic collectors and the anionic and/or nonionic collectors were used in the rougher flotation stage.

600 g of the ore, coarsely size-reduced beforehand, were ground in a bar mill for 45 minutes in the presence of 13.4 mg of sodium metasilicate, 40.2 mg of sodium hydroxide and approximately 400 ml of flotation water (hardness: 14.7 mg/l $CaCl_2 \cdot 2H_2O$ and 4.9 mg/l $MgSO_4 \cdot 7H_2O$). The ground ore had the following particle size distribution:

>31 μm: 7.7% by weight 11 to 31 μm: 45.3% by weight

<11 μm: 47.0% by weight.

The finely ground ore was then transferred to the desludging stage and diluted to approximately 8 liters (solids content: 7% by weight). 3 ml of heat-treated cornstarch (2.25% by weight) were then added and the supernatant sludge was removed after 2 minutes.

The desludged flotation batch (volume: approximately 1 l) was transferred to a 2 liter stirred Denver cell (type D1). 67 ml of sodium hydroxide and 12 ml of cornstarch (2.25% by weight) were then added, the cell was filled with flotation water and the liquid with solid material in suspension was conditioned while stirring for 2 minutes. The aminic collector and the anionic and/or nonionic collectors were then introduced. The rougher flotation stage was then carded out at a stirrer speed of 1,200 r.p.m., a foam product and a concentrate being obtained in the cell. After the addition of more collector, flotation was carried out for a second time; another foam product and the desired iron ore concentrate were obtained. Particulars of the flotation tests can be found in Tables 4, 5 and 6.

TABLE 4a

Hematite, sample I: Collector systems and quantities used

| Ex. | Collector A | Quantity used FS I g/t | Quantity used FS II g/t | Collector B | Quantity used g/t |
|---|---|---|---|---|---|
| 1 | A1 | 48 | 48 | B1 | 90 |
| 2 | A1 | 48 | 48 | B1 | 180 |
| 3 | A1 | 48 | 96 | B1 | 180 |
| 4 | A2 | 48 | 48 | B2 | 126 |
| 5 | A1 | 48 | 48 | B3 | 60 |
| 6 | A1 | 48 | 48 | B1/B3 | 60/60 |
| 7 | A1 | 32 | 32 | B1/B3 | 80/9 |
| 8 | A1 | 32 | 32 | B1/B3 | 80/9 |
| 9 | A1 | 48 | 48 | B1/B3 | 39/39 |
| 10 | A1 | 36 | 48 | B1/B3 | 45/45 |
| 11 | A1 | 36 | 48 | B1/B3 | 60/60 |
| C1 | A1 | 48 | 48 | — | — |

TABLE 4b

Hematite, sample II: Collector and quantities used

| Ex. | Collector A | Quantity used FS I g/t | Quantity used FS II g/t | Collector B | Quantity used g/t |
|---|---|---|---|---|---|
| 12 | A1 | 48 | 48 | B1/B3 | 60/60 |
| 13 | A1 | 48 | 48 | B1/B3 | 84/36 |
| 14 | A1 | 48 | 96 | B1/B3 | 96/24 |
| 15 | A1 | 48 | 48 | B1/B3 | 108/12 |
| 16 | A1 | 48 | 48 | B1/B3 | 48/72 |
| 17 | A1 | 48 | 48 | B4/B5/B6 | 24/40/80 |
| 18 | A1 | 48 | 48 | B4/B5/B6 | 10/34/100 |
| 19 | A1 | 48 | 48 | B4/B5/B6 | 28/21/95 |
| 20 | A1 | 48 | 48 | B4/B5/B6 | 20/57/67 |
| C2 | A1 | 48 | 48 | — | — |

TABLE 4b-continued

| | Hematite, sample II: Collector and quantities used | | | | |
|---|---|---|---|---|---|
| | | Quantity used | | | |
| Ex. | Collector A | FS I g/t | FS II g/t | Collector B | Quantity used g/t |

Legend: FS I: Flotation stage I
FS II: FLotation stage II

Legend: FS I: Flotation stage I FS II: Flotation stage II

TABLE 5a

| | Hematite, sample I: Desludging results Percentages as % by weight | | | | |
|---|---|---|---|---|---|
| | Sludge | | | | Batch |
| Ex. | Quantity % | Fe % | P % | $SiO_2$ % | P % |
| 1 | 30.2 | 12.8 | 0.051 | 75.8 | 0.038 |
| 2 | 29.9 | 12.6 | 0.055 | 76.1 | 0.039 |
| 3 | 29.9 | 12.6 | 0.055 | 76.1 | 0.039 |
| 4 | 29.6 | 12.8 | 0.049 | 73.1 | 0.036 |
| 5 | 26.9 | 13.3 | 0.052 | 76.4 | 0.034 |
| 6 | 26.9 | 13.9 | 0.053 | 77.8 | 0.035 |
| 7 | 28.1 | 12.1 | 0.058 | 75.2 | 0.038 |
| 8 | 27.1 | 12.6 | 0.055 | 75.0 | 0.037 |
| 9 | 27.2 | 13.9 | 0.055 | 77.9 | 0.037 |
| 10 | 29.8 | 11.4 | 0.057 | 76.8 | 0.039 |
| 11 | 31.5 | 11.1 | 0.053 | 74.3 | 0.039 |
| C1 | 29.2 | 13.7 | 0.057 | 74.8 | 0.038 |

TABLE 5b

| | Hematite, sample II: Desludging results Percentages as % by weight | | | | |
|---|---|---|---|---|---|
| | Sludge | | | | Batch |
| Ex. | Quantity % | Fe % | P % | $SiO_2$ % | P % |
| 12 | 27.3 | 8.5 | 0.054 | 88.8 | 0.026 |
| 13 | 28.6 | 9.9 | 0.052 | 86.1 | 0.027 |
| 14 | 31.9 | 10.1 | 0.046 | 78.1 | 0.025 |
| 15 | 28.3 | 8.6 | 0.050 | 82.4 | 0.025 |
| 16 | 30.9 | 10.1 | 0.047 | 83.4 | 0.026 |
| 17 | 29.6 | 10.3 | 0.050 | 81.9 | 0.026 |
| 18 | 30.7 | 9.9 | 0.045 | 79.7 | 0.024 |
| 19 | 30.6 | 9.9 | 0.046 | 82.4 | 0.025 |
| 20 | 30.2 | 9.5 | 0.048 | 85.7 | 0.025 |
| C2 | 26.0 | 8.6 | 0.053 | 85.8 | 0.025 |

TABLE 6a

| | | Hematite, sample I: Concentrations based on mill batch Percentages as % by weight | | | | |
|---|---|---|---|---|---|---|
| | | Iron concentrate | | | | Recovery |
| Ex. | TC min. | Quantity % | Fe % | $SiO_2$ % | P % | Fe % |
| 1 | 2 | 39.8 | 67.8 | 5.5 | 0.035 | 72.5 |
| 2 | 2 | 41.5 | 66.5 | 6.2 | 0.032 | 75.3 |
| 3 | 2 | 38.0 | 68.1 | 3.9 | 0.031 | 70.6 |
| 4 | 0 | 30.2 | 67.9 | 6.0 | 0.032 | 55.0 |
| 5 | 0 | 36.9 | 67.2 | 5.6 | 0.029 | 65.9 |
| 6 | 4 | 38.1 | 68.4 | 5.9 | 0.028 | 68.4 |

TABLE 6a-continued

| | | Hematite, sample I: Concentrations based on mill batch Percentages as % by weight | | | | |
|---|---|---|---|---|---|---|
| | | Iron concentrate | | | | Recovery |
| Ex. | TC min. | Quantity % | Fe % | $SiO_2$ % | P % | Fe % |
| 7 | 0 | 38.9 | 65.4 | 4.9 | 0.029 | 70.7 |
| 8 | 0 | 31.5 | 66.1 | 3.6 | 0.025 | 58.0 |
| 9 | 2 | 37.9 | 70.1 | 3.8 | 0.034 | 69.5 |
| 10 | 0 | 34.9 | 65.5 | 4.1 | 0.030 | 64.0 |
| 11 | 0 | 33.8 | 66.6 | 4.1 | 0.029 | 63.1 |
| C1 | 0 | 33.9 | 66.8 | 5.0 | 0.044 | 60.6 |

TABLE 6b

| | | Hematite, sample II: Concentrations based on mill batch Percentages as % by weight | | | | |
|---|---|---|---|---|---|---|
| | | Iron concentrate | | | | Recovery |
| Ex. | TC min. | Quantity % | Fe % | $SiO_2$ % | P % | Fe % |
| 12 | 0 | 32.8 | 69.8 | 3.1 | 0.012 | 57.4 |
| 13 | 0 | 31.8 | 68.8 | 2.7 | 0.013 | 56.1 |
| 14 | 0 | 33.4 | 68.5 | 2.3 | 0.012 | 60.2 |
| 15 | 0 | 33.5 | 68.4 | 2.4 | 0.012 | 60.1 |
| 16 | 0 | 31.7 | 67.7 | 3.2 | 0.013 | 56.5 |
| 17 | 0 | 31.5 | 68.2 | 3.1 | 0.011 | 55.2 |
| 18 | 0 | 30.9 | 68.1 | 3.4 | 0.010 | 55.1 |
| 19 | 0 | 31.0 | 67.5 | 3.5 | 0.010 | 55.3 |
| 20 | 0 | 31.9 | 68.2 | 3.5 | 0.014 | 57.3 |
| C2 | 0 | 32.4 | 70.2 | 2.5 | 0.021 | 57.5 |

Addition sequence of the collectors [Examples];

| | | |
|---|---|---|
| a) | Rougher 1 | collector A, collector B [1–5, 7, 10, 11, C1] |
| b) | Rougher 1 | collector A and collectors B1 and B3 [6] |
| c) | Preliminary flotation | collector B [8] |
| | Rougher 1, 2 | collector A |
| d) | Rougher 1 | collector A, collector B (30/30 g/t) |
| | Rougher 2 | collector A, collector B ( 9/9 g/t) [9] |
| e) | Rougher 1 | collector A, collector B, no conditioning [12–20, C2] |
| TC | | total conditioning time |

IV. Flotation examples for magnetite ore

A magnetite ore with the chemical composition shown in II) was used; it had a particle size of 89% by weight <43 μm. Flotation was again carried out in a 2-liter Denver cell (type D1) with a suspended solids density of approximately 220 g/l in water with a calcium ion content of 4 mg/l. The pH value of the liquid with solids in suspension was adjusted to 8.5 by addition of sodium hydroxide; the stirrer speed was 1,200 r.p.m. After the addition of collector and frother, air was introduced at a flow rate of 130 to 150 l/h for flotation. The foam was removed over a period of 2 minutes in the general silicate flotation phase, the flotation time being extended in an additional phosphate flotation phase, as shown in Table 7.

The aminic collector was added in the form of a 0.25% by weight aqueous solution while the anionic collector mixtures were added in the form of 5% by weight aqueous solutions. In all the flotation tests, a commercial frother based on aldehydes, alcohols and esters was used in a quantity of 30 g/t, being introduced into the liquid with solids in suspension in undiluted form.

TABLE 7a

| Ex. | Collector A | Quantity used g/t | Collector B | Quantity used g/t |
|---|---|---|---|---|
| | Magnetite: Collector system and quantities used | | | |
| 21 | A3 | 65 | B6 | 95 |
| 22 | A3 | 65 | B7 | 100 |
| 23 | A3 | 65 | B1/B3 | 60/7 |
| 24 | A3 | 65 | B1/B3 | 60/7 |
| 25 | A3 | 65 | B4/B5/B6 | 9/14/28 |
| 26 | A3 | 65 | B4/B5/B6 | 9/14/28 |
| 27 | A3 | 65 | B1/B3 | 60/7 |
| 28 | A3 | 65 | B4/B5/B6 | 9/14/28 |
| C3 | A3 | 65 | — | — |

TABLE 7b

| Ex. | Iron concentrate Quantity % | Iron concentrate Fe % | Iron concentrate $SiO_2$ % | Iron concentrate P % | Recovery Fe % |
|---|---|---|---|---|---|
| | Percentages as % by weight | | | | |
| 21 | 87.7 | 67.6 | 4.6 | 0.011 | 91.3 |
| 22 | 91.4 | 68.1 | 4.2 | 0.012 | 95.1 |
| 23 | 86.2 | 68.6 | 3.8 | 0.011 | 89.7 |
| 24 | 92.2 | 67.7 | 4.9 | 0.012 | 94.5 |
| 25 | 88.7 | 68.5 | 4.2 | 0.010 | 91.9 |
| 26 | 89.2 | 68.0 | 4.5 | 0.010 | 92.0 |
| 27 | 91.7 | 67.4 | 4.9 | 0.011 | 94.0 |
| 28 | 91.3 | 66.9 | 4.7 | 0.011 | 93.7 |
| C3 | 92.1 | 68.3 | 3.9 | 0.015 | 95.3 |

Flotation sequence and flotation times [Examples]:

a) Silicate flotation 2 mins., apatite flotation 1 min. [21–23,25,C3]

b) Apatite flotation 0.5 mins., silicate flotation 2.5 mins. [24]

c) Apatite flotation and silicate flotation together 2.5 mins. [27,28]

We claim:

1. In a process for the removal of phosphorous from, and for the production of, iron ore concentrates by flotation, in which crushed crude iron ore is mixed with water and a collector to form a suspension, air is introduced into the suspension in the presence of a reagent system and a floated foam containing said phosphorous formed therein along with a flotation residue comprising an iron concentrate, wherein the improvement comprises using as the collector, a mixture containing:

a) from about 10 to about 60% by weight of at least one ether amine corresponding to formula (I):

$$R'O-(C_nH_{2n})^y-NH-(C_nH_{2n}-NH)_xH \quad (I)$$

in which R' is a linear or branched aliphatic hydrocarbon moiety having from 6 to 22 carbon atoms and 0, 1, 2 or 3 double bonds; n and m independently of one another represent the number 1, 2 or 3; x=0 or the number 1, 2 or 3 and y=2 or 3; and b) the remainder being at least one other anionic or nonionic surfactant collector, in which the anionic surfactant collector is selected from the group consisting of fatty acids, alkyl sulfates, alkylether sulfates, alkyl sulfosuccinates, alkylsulfocinnamates, alkyl benzene sulfonates, acyl lactylates, alkyl phosphates, alkylether phosphates and ether carboxylic acids, and in which the nonionic surfactant collector is selected from the group consisting of fatty alcohol polyglycol ethers, alkylphenol polyglycol ethers fatty acid polyglycol esters, fatty acid amide polyglycol ethers, mixed ethers, hydroxy mixed ethers and alkyl glycosides, and in which the residual phosphorous content in the iron concentrate produced is no more than 0.015% by weight based on the iron concentrate.

2. A process as claimed in claim 1, wherein the collector mixtures contain ether amines of formula (I), in which R' is a $C_{6-18}$ alkyl moiety.

3. A process as claimed in claim 2, wherein the collector mixtures are used in quantities of 20 to 2,000 g/t of crude iron ore.

4. In a process for the removal of phosphorous from, and for the production of iron ore concentrates by flotation, in which crushed crude iron ore is mixed with water and a collector to form a suspension, air is introduced into the suspension in the presence of a reagent system and a floated foam containing said phosphorous formed therein along with a flotation residue comprising an iron concentrate, wherein the improvement comprises using as the collector, a mixture consisting essentially of:

a) from about 10 to about 60% by weight of the collector mixture, of at least one ether amine corresponding to formula (I):

$$R'O-(C_nH_{2n})^y-NH-(C_nH_{2n}-NH)_xH \quad (I)$$

in which R' is a linear or branched aliphatic hydrocarbon moiety having from 6 to 22 carbon atoms and 0, 1, 2 or 3 double bonds; n and m independently of one another represent the number 1, 2 or 3; x=0 or the number 1, 2 or 3 and y=2 or 3; and b) at least one other anionic surfactant collector (i) and/or nonionic surfactant collector (ii) selected from the group consisting of fatty alcohol polyglycol ethers, alkylphenol polyglycol ethers fatty acid polyglycol esters, fatty acid amide polyglycol ethers, mixed ethers, hydroxy mixed ethers and alkyl glycosides, and in which the residual phosphorous content in the iron concentrate produced is no more than 0.015% by weight based on the iron concentrate.

5. A process as claimed in claim 4, wherein the collector mixtures are used in quantities of 20 to 2,000 g/t of crude iron ore.

6. A process as claimed in claim 5, wherein R' in the ether amine formula (I) is a $C_{6-18}$ alkyl moiety.

7. A process as claimed in claim 1, wherein the collector mixtures are used in quantities of 20 to 2,000 g/t of crude iron ore.

* * * * *